United States Patent [19]

Gauberthier et al.

[11] 4,251,247

[45] Feb. 17, 1981

[54] METHOD AND APPARATUS FOR COOLING A GASEOUS MIXTURE

[75] Inventors: Joseph J. Gauberthier; Henri Paradowski, both of Rueil-Malmaison, France

[73] Assignee: Compagnie Francaise d'Etudes et de Construction Technip, Rueil-Malmaison, France

[21] Appl. No.: 53,053

[22] Filed: Jun. 28, 1979

Related U.S. Application Data

[63] Continuation of Ser. No. 941,923, Sep. 13, 1978, abandoned, which is a continuation of Ser. No. 792,801, May 2, 1977, abandoned, which is a continuation of Ser. No. 580,707, May 27, 1975, abandoned.

[30] Foreign Application Priority Data

May 31, 1974 [FR] France ..... 74 19008

[51] Int. Cl.[3] ..... F25J 1/02

[52] U.S. Cl. ..... 62/9; 62/40; 62/114; 62/24; 62/510

[58] Field of Search ..... 62/9, 40

[56] References Cited

U.S. PATENT DOCUMENTS

| | | | |
|---|---|---|---|
| 3,418,819 | 12/1968 | Grunberg et al. | 62/40 |
| 3,593,535 | 7/1971 | Gaumer, Jr. | 62/40 |
| 3,596,473 | 12/1968 | Streich | 62/40 |
| 3,747,359 | 7/1973 | Streich | 62/40 |
| 3,964,891 | 6/1976 | Krieger | 62/40 |

*Primary Examiner*—Norman Yudkoff
*Attorney, Agent, or Firm*—Kenyon & Kenyon

[57] ABSTRACT

Method and apparatus for cooling a gaseous mixture wherein a fractional condensation of said mixture is carried out under a high pressure by using at least a first stage and a last stage of fractional condensation, the penultimate and the last condensed fractions are expanded down to a low pressure forming a main refrigerating stream, and at least the first condensed fraction of the cycle mixture is expanded down to an intermediate pressure between said high pressure and said low pressure forming an auxiliary refrigerating stream.

15 Claims, 5 Drawing Figures

METHOD AND APPARATUS FOR COOLING A GASEOUS MIXTURE

Figure 1:
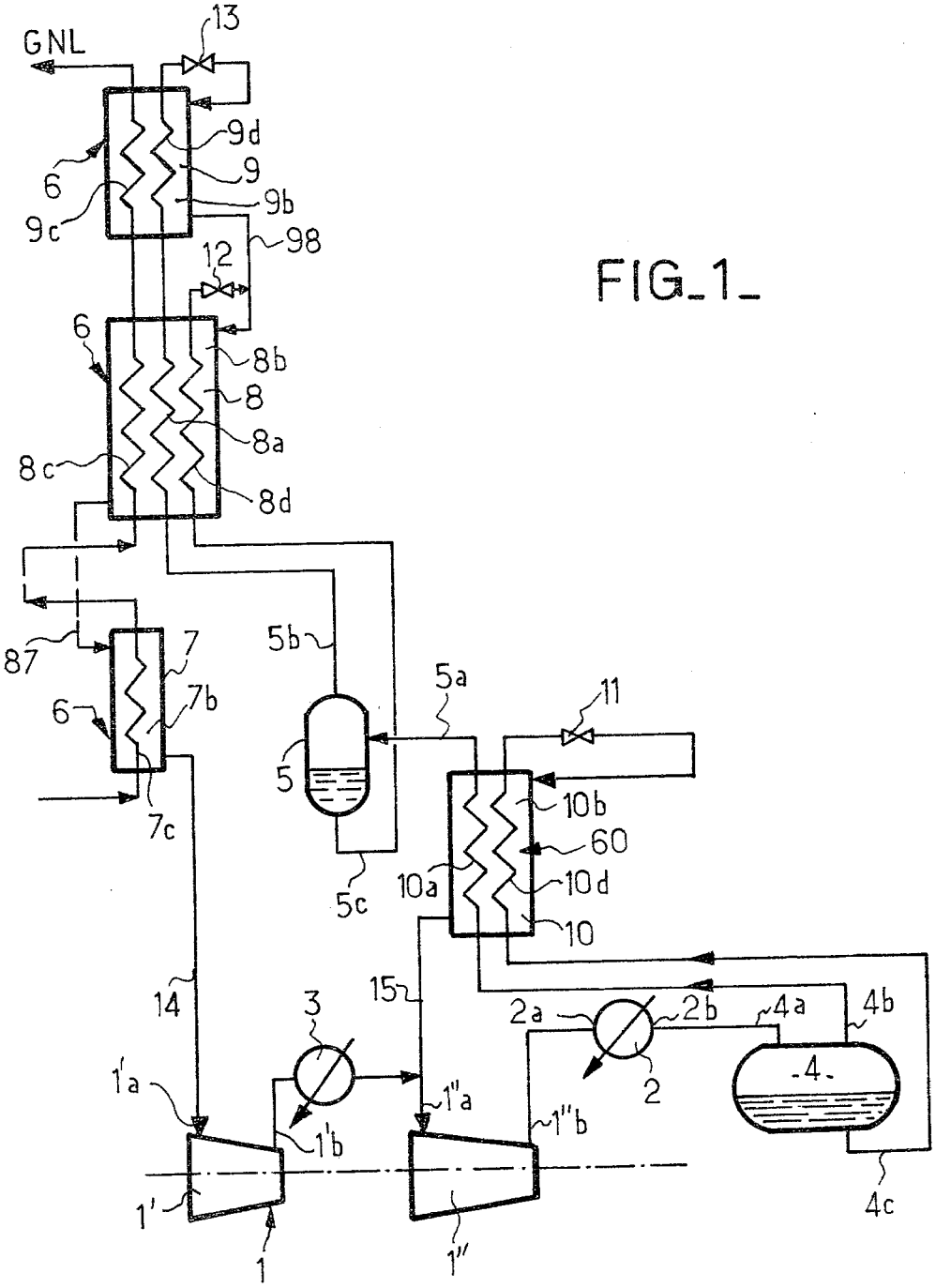

This is a continuation, of application Ser. No. 941,923 filed Sept. 13, 1978, abandoned, which is a continuation of Ser. No. 792,801 filed May 2, 1977, abandoned which in turn is a continuation of Ser. No. 580,707 filed May 27, 1975, abandoned.

The present invention relates to a method of cooling a gaseous mixture and more particularly for cooling, condensing and possibly sub-cooling a natural gas or the like and to an arrangement, system, apparatus or like means for carrying out said method.

More specifically the invention is dealing with a cooling process such as disclosed by A. P. KLEEMENKO at the Symposium on Cold held in 1959 in Copenhagen (see transactions: pages 34 to 39), by means of at least one refrigerating or freezing cycle of the closed-loop type known as "incorporated-cascade cycle" using a cycle mixture or compound comprising a plurality or blend of components; in the case of the liquefaction of a natural gas many components of the cycle mixture or compound may be identical with those of the processed gaseous mixture. Such a refrigerating cycle comprises the following steps:

(a) effecting a fractional condensation at high pressure of the cycle mixture including at least:

a first stage of fractional condensation during which the cycle mixture is partially condensed through heat exchange with an outer refrigerant, coolant or like freezing agent or chilling medium whereupon the partially condensed cycle mixture is separated or split up into a first condensed fraction and a first vapour fraction, a last stage of fractional condensation consisting in partially condensing the last but one vapour fraction of the cycle mixture, separating or splitting up the partially condensed last but one vapour fraction into a last vapour fraction and a last but one condensed fraction, fully condensing the last vapour fraction for providing the last condensed fraction.

The various condensed fractions of the cycle mixture inclusive of the last condensed fraction other than the first condensed fraction are obtained through partial or total condensation of the preceding vapour fraction through heat exchange in countercurrent flowing relationship exclusively with a refrigerating, cryogenic or cooling stream of the cycle mixture while being heated up under a low pressure lower than the high pressure; thus the last condensed fraction of the cycle mixture is obtained through heat exchange in counter-current flowing relationship between the last but one vapour fraction and the refrigerating stream being heated up under a low pressure.

(b) carrying out the whole cooling down of the gaseous mixture inclusive of the final part of this cooling down through heat exchange in counter-current flowing relationship exclusively with the refrigerating stream being heated up under a low pressure, (c) expanding down to the low pressure at least one part if not the whole thereof, of the last condensed fraction of the cycle mixture and the part thus expanded forms at least one initial portion of said refrigerating stream, (d) expanding down to the low pressure at least one part if not the whole of all the other condensed fractions of the cycle mixture inclusive of the first condensed fraction preceding the last condensed fraction and adding together the parts thus expanded to the refrigerating stream, (e) compressing again the reheated refrigerating stream from the low pressure to the high pressure for restoring at least in part the cycle mixture under the high pressure.

Within the scope of its works and researches relating to the liquefaction of natural gas the applicant has endeavoured to improve the previously defined cycle performances in terms of power, i.e. essentially to decrease the compression power used while reducing the size of the plant or equipment (essentially that of the compression means) required for practicing the refrigeration cycle.

It has then been found that such an object could be accomplished or met through the co-operation of the following measures or expedients:

(f) obtaining at least one condensed fraction of the cycle mixture intermediate the first condensed fraction and the last condensed fraction through partial condensation of the preceding vapour fraction through heat exchange in counter-current flowing relationship exclusively with an intermediate refrigerating stream of the cycle mixture distinct from said refrigerating stream under low pressure being heated up under an intermediate pressure lying between the low pressure and the high pressure, (g) expanding down to this intermediate pressure at least one part of at least another condensed fraction of the cycle mixture preceding said intermediate condensed fraction for providing at least one initial part of said intermediate refrigerating stream, (h) compressing again said reheated intermediate refrigerating stream previously combined with said refrigerating stream compressed again up to the intermediate pressure for raising the pressure from the latter to the high pressure.

According to a preferred form of embodiment of the present invention the process comprises the steps of effecting at least one part of the initial cooling down of the processed gaseous mixture through heat exchange in counter-current flowing relationship with the intermediate refrigerating stream being heated up under the intermediate pressure and then effecting the final cooling down of the gaseous mixture through heat exchange in counter-current flowing relationship with said refrigerating stream being heated up under the low pressure.

At first with a same total heat exchange surface area the combination of the operating steps (f) to (h) enables to increase by at least about 12% the compression power consumed with respect to the prior art cooling method of the closed-loop type previously defined, known as an "incorporated-cascade cycle" and operating at one and a same cycle mixture reheating pressure.

The reheating step of the intermediate refrigerating stream of the cycle mixture performed under an intermediate pressure lying between the low pressure and the high pressure of the refrigerating cycle enables to carry out the second stage of fractional condensation and possibly the third stage of fractional condensation of the cycle mixture with an improved heat exchange efficiency or yield between the cycle mixture being reheated on the one hand and the cycle mixture undergoing cooling down and fractional condensation on the other hand. According to the previously defined prior art indeed this or these stages of fractional condensation were carried out in a cooling range approximatively lying between +30° C. and −60° C. through heat exchange with the refrigerating stream of the cycle mixture being reheated under the low pressure. Therefore according to this prior art the cycle mixture through its being heated up again supplied the required cold to the fractional condensation of said mixture at a temperature level too low in relation to the temperature level strictly required for carrying out the second and possibly third stages of fractional condensation. By way of comparison and according to the invention the reheating of the intermediate refrigerating stream of the cycle mixture effected under an intermediate pressure generally higher than the low pressure previously contemplated will provide the cold required for carrying on or proceeding with the fractional condensation of the cycle mixture at a relatively higher temperature level than that obtained according to the prior art. Correlatively in the previously mentioned cooling range (+30° C. to about −60° C.) the temperature difference between the cycle mixture being heated up and the cycle mixture undergoing fractional condensation is decreased and therefore the overall power efficiency or yield of the refrigerating cycle is improved.

Moreover the combination of the operating steps (f) to (h) enables to decrease to a large extent the size of the compressor or compressors required for compressing again the cycle mixture with respect to that of the compressor or compressors required for carrying out the prior art method of cooling down previously defined; this would leave the man skilled in or conversant with the art free to choose between all the rotary compressor types whether they are axial-flow or centrifugal compressors.

This improvement obtained according to the invention results partially from the following technical considerations:

(1) The volumetric flow rate of each one of the refrigerating stream and intermediate refrigerating stream of the cycle mixture is smaller than the volumetric flow rate of the single refrigerating stream of the cycle mixture heated up according to the prior art under one and a same low pressure while cooling both of the cycle mixture and the processed gaseous mixture; as a matter of fact according to the invention each one of the aforementioned streams does only effect one part of the step for cooling down the processed gaseous mixture and/or cycle mixture, (2) The mass flow rate of the intermediate refrigerating stream is in general much higher than that of the refrigerating stream under the low pressure; correlatively according to the invention the major part of the cycle mixture is drawn in under the intermediate pressure hence under a suction pressure generally higher than the suction pressure of the cycle mixture according to the method of cooling of the prior art.

Furthermore for grounds similar to those set forth previously with a same production rate or yield capacity and with respect to working a cycle according to the prior art the combination of the operating steps (f) to (h) enables to significantly decrease the overall sizes of the heat exchangers and allows for a better distribution among the various exchanges of the whole heat exchanging surface area required for carrying out the refrigerating cycle. Thereby is achieved an overall improvement to the compactness of the cooling plant making use of the refrigerating cycle according to the invention.

Throughout the present specification and in the claims by the terms of:

gaseous mixture is meant a gas to be cooled comprising a plurality of components or pure substances or bodies; a natural gas complies in particular with such a definition since it includes for instance nitrogen, methane, ethane, propane, butane and so on, cycle mixture is meant a gas comprising a plurality of components or pure substances or bodies flowing along a closed circuit or loop in a refrigerating cycle and the only function of which is to produce or generate cold; in the case of the cooling down of a natural gas the cycle mixture includes several components of the gaseous mixture to be cooled, outer refrigerant is meant a coolant distinct from the cycle mixture and providing in particular for the partial condensation of the cycle mixture during the first stage of fractional condensation and/or the partial condensation of the cycle mixture compressed again up to the intermediate pressure. This refers either to a liquid refrigerant or coolant being heated up, for instance water, or to a refrigerant undergoing vaporization, for instance propane. In the latter case any other refrigerant equivalent to propane may be selected; it may for instance be a mixture or blend of pure substances or bodies (propane and propylene for instance) or one and a same pure body or single substance (butane for instance); it may also be ammonia or fluorinated hydrocarbon-based refrigerants known under the name "Freons". In the latter case the cooling method according to the invention may make use of an another refrigerating cycle or auxiliary refrigerating cycle successively comprising a compression of the outer refrigerant in gaseous condition, a condensation of the compressed refrigerant through heat exchange with another outer refrigerant or coolant such as water, an expansion of said condensed refrigerant, a vaporization of said expanded refrigerant through heat exchange with at least one cycle mixture under the high pressure during the first stage of fractional condensation, said vaporized refrigerant being recycled to the compression step, composition if not otherwise stated is meant a volumetric composition of a gas (cycle mixture, gaseous blend or compound, gaseous fractions, vapour, etc . . . ) expressed in terms of volumetric percentages, heat exchange assembly or arrangement is meant:

either a single heat exchanger for instance of the coiled heat exchanger kind comprising a single hood, housing, casing or like shell inside of which are located on the one hand at least one duct or pipe for total condensation of the cycle mixture and on the other hand at least one cooling passage-way for the processed gaseous mixture, the inside of the single casing then performing the function of a passage-way for the vaporization or reheating of the refrigerating stream under the low pressure, or a plurality of heat exchangers arranged in series at least one of which comprises a duct or pipe for the total condensation of the cycle mixture; each exchanger comprises on the one hand a cooling circuit for the processed gaseous mixture and on the other hand a vaporization or reheating circuit for the refrigerating stream under the low pressure in heat exchanging relationship with said cooling circuit and possibly with said total condensation circuit; the various vaporization circuits are connected to each other in series and perform together the function of a vaporization passage-way for the refrigeration stream under the low pressure; likewise the various cooling circuits are connected to each other in series and perform together the function of the cooling passage-way for the treated gaseous mixture, intermediate heat exchanging assembly or system is meant:

either one single heat exchanger for instance of the coiled heat exchanger type comprising a single hood, housing, casing or like shell inside of which is located at least one duct or pipe for the partial condensation of the cycle mixture, the inside of the single casing then performing the function of the vaporization or reheating passage-way for the intermediate refrigerating stream, or a plurality of heat exchangers arranged in series and each one comprising at least one duct or pipe for the partial condensation of the cycle mixture and a vaporization or reheating circuit for the intermediate refrigerating stream in heat exchanging relationship with said partial condensation duct; the various vaporization circuits are connected to each other in series and perform together the function of the vaporization or reheating passage-way for the intermediate refrigerating stream.

Except when otherwise stated in the present specification and in the claims with the terms "to cool" and "cooling" are meant an operating step through which the temperature of a gas comprising several components (gaseous blend, cycle mixture or compound, gaseous fractions, vapour, etc . . . ) is lowered and involving at least one of the following phenomena:

(1) a cooling of said gas from an initial temperature close to or lower than room or ambient or environmental temperature down to a final temperature equal to or higher than the dew point temperature of said gas the latter remaining in the gaseous state, (2) a condensation of said gas (being initially at its dew point temperature) which may be partial or total or fractional. In the case of a partial condensation the temperature of said gas is lowered from its dew point temperature down to a temperature higher than its boiling temperature. In the case of a total condensation the temperature of said gas is lowered from its dew point temperature down to its boiling temperature. Wtih fractional condensation is meant an operating step including at least one stage of fractional condensation, said stage successively comprising:

a partial condensation of said gas or of a vapour fraction of the latter, a separation of said plurality condensed gas or of the partially condensed vapour fraction into a vapour fraction and a condensed fraction, possibly (when the last stage of fractional condensation or one and a same stage of fractional condensation is referred to), a total condensation of the previously separated vapour fraction for obtaining a last condensed fraction, (3) a sub-cooling of said preliminarily condensed gas or of at least one condensed fraction of said gas when the latter has undergone a fractional condensation through which the temperature of said condensed gas or of at least said condensed fraction is lowered from an initial temperature close to the boiling temperature of said condensed gas or of said condensed fraction down to a final temperature.

In the case of the cycle mixture the fractional condensation involved by the invention comprises at least two stages of fractional condensation such as defined previously and the number of separating flasks providing each one for the separation of a condensed fraction and of a vapour fraction is equal to the number of stages of the fractional condensation of the cycle mixture.

In the case of the processed gaseous mixture when the latter is subjected to a fractional condensation at least one separation into a condensed fraction and a vapour fraction may be carried out by rectifying a corresponding at least partially condensed treated gaseous mixture or by rectifying a corresponding also partially condensed vapour fraction thereof.

Except when otherwise stated in the present specification and in the claims with the terms "to reheat" and "reheating" are meant an operating step through which is increased the temperature of a liquid including several components (liquid fractions, condensed fractions, etc.) or of a two-phase liquid-gas mixture (cycle mixture, refrigerating stream and intermediate refrigerating stream) comprising such a liquid, involving at least one of the following phenomena:

(1) a total vaporization of said liquid or of said two-phase mixture being initially at the boiling temperature of said liquid by increasing the temperature of said liquid or of said two-phase mixture from the boiling temperature of said liquid up to the dew point temperature of said liquid, (2) a reheating or heating up of said vaporized liquid or of said vaporized two-phase mixture from an initial temperature equal to or higher than the dew point temperature of said vaporized liquid up to a final temperature about or lower than the ambient or room temperature.

The two-phase mixture contemplated previously may undergo several successive vaporizations according to the previous definition corresponding each one to the admixing of a new liquid to said mixture.

With the terms refrigerating stream is meant a stream or flow of the cycle mixture intended to cool a cycle mixture and/or a processed gaseous mixture flowing from the cold end to the hot or warm end of a heat exchanging assembly and resulting initially (that is at the cold end of said assembly) from the input and then from the vaporization within said heat exchanging assembly of at least one expanded part of a condensed fraction of the cycle mixture which is joined during the progress or advance of said stream towards the hot end of said assembly by at least one part of at least another condensed fraction of the cycle mixture.

The present invention will be better understood and further objects, details, characterizing features and advantages thereof will appear more clearly as the following explanatory description proceeds with reference to the accompanying diagrammatic drawings given by way of non-limitative examples only illustrating several presently preferred specific forms of embodiment of the invention and wherein:

FIG. 1 diagrammatically shows a plant according to the invention for cooling a natural gas; and FIGS. 2 to 5 diagrammatically show further plants for cooling a natural gas, respectively, according to the present invention.

Referring to FIG. 1 a plant for cooling a natural gas (processed gaseous mixture) according to the invention comprises (a) a compression means 1 the suction side or input 1'a and the delivery or discharge side or output 1''b of which operate under a low pressure LP and a high pressure HP, respectively; this compression means comprises a first stage 1' the suction side or input 1'a and the delivery or discharge side or output 1'b of which are respectively working under the low pressure LP and under an intermediate pressure IP lying between the low pressure LP and the high pressure HP and an other or second stage 1'' the suction side or inlet 1''a and the delivery or discharge side or outlet 1''b are respectively working under the intermediate pressure IP and under the high pressure HP; the delivery or discharge side or output 1'b of the first stage 1' communicates with the suction side or input 1''a of the second stage 1'' through the medium of a duct or pipe-line in which is connected a cooler 3 comprising means for circulating an outer coolant or cooling medium, (b) a condenser 2 the inlet 2a of which communicates with the delivery or discharge side or outlet 1''a of the compression means 1 and including means for circulating an outer coolant, (c) a plurality of say two separate 4 and 5 arranged in series and each one comprising a two-phase flow inlet denoted by the subscript a, a liquid outlet denoted by the subscript c and a gaseous flow outlet denoted by the subscript b; the two-phase flow inlet 4a of the first separator 4 communicates with the outlet 2b of the condenser 2; the two-phase flow inlet 5a of the second or last separator 5 communicates with the gaseous medium outlet 4b of the first or last but one separator 4, (d) a heat exchanging system 6 co-operating with the second or last separator 5 for completing the fractional condensation of the cycle mixture and comprising three distinct exchangers 7, 8 and 9. This sytem comprises on the one hand a total condensation duct or pipe 8a for the last vapour fraction of the cycle mixture arranged within the exchanger 8 the inlet of which communicates with the gaseous medium outlet 5b of the second or last separator 5 on the other hand a vaporization passage-way in heat exchanging relationship with the total condensation duct 8a consisting of the communication provided in series between the inside 9b of the casing of the exchanger 9, the connecting pipe-line 98 between the exchange 9 and 8, the inside 8b of the casing of the exchanger 8, the connecting pipe-line 87 between the exchangers 8 and 7 and the inside 7b of the casing of the exchanger 7, and finally a cooling passageway in heat exchanging relationship with the vaporization passage-way previously defined and consisting of the communication provided in series between the ducts 7c of the exchanger 7, 8c of the exchanger 8 and 9c of the exchanger 9. The exchanger 9 moreover comprises a duct or pipe 9d for sub-cooling the last condensed fraction of the cycle mixture in heat exchanging relationship with the vaporization passage-way (9b, 98, 8b, 87, 7b). The exchanger 8 further comprises a sub-cooling duct or pipe 8d for the last but one or second condensed fraction of the cycle mixture in heat exchanging relationship with the same vaporization passage-way, (e) an intermediate heat exchanging system 60 distinct from the heat exchanging system 6 and consisting of one single exchanger 10. This assembly comprises on the one hand a partial condensation duct or pipe 10a for the first vapour fraction of the cycle mixture the outlet of which communicates with the two-phase flow inlet 5a of the separator 5 provided after the first separator 4 and the inlet of which communicates with the gaseous flow outlet 4b of the first separator 4 provided before the second or intermediate separator 5, on the other hand an intermediate vaporization passage-way 10b in heat exchanging relationship with the partial condensation duct or pipe 10a. Moreover the exchanger 10 further comprises a duct or pipe 10d for sub-cooling the first condensed fraction of the cycle mixture in heat exchanging relationship with the intermediate vaporization passage-way 10b, (f) a plurality of, say three successive expansion means or valves 11, 12 and 13; the upstream side of the last or third expansion means 13 communicates with the outlet of the total condensation duct 8a through the agency of the sub-cooling duct 9b of the exchanger 10; the upstream side of the last but one or second expansion means 12 communicates with the liquid flow outlet 5c of the second or last separator 5 through the agency of the subcooling duct 8d of the exchanger 8; the downstream side of the last or third and last but one or second expansion means 13 and 12 communicates with the vaporization passage-way previously defined (9b, 98, 8b, 87, 7b), (g) the upstream side of the first expansion means 11 or intermediate expansion means arranged upstream of the last but one or second expansion means 12 communicates with the liquid flow outlet 4c of the separator 4 provided before the second separator 5 or intermediate separator whereas the downstream side of this same intermediate expansion means 11 or first expansion valve communicates with the intermediate vaporization passage-way 10b defined previously, (h) a return pipe-line 14 the upstream side of which communicates with the vaporization passage-way (9b, 98, 8b, 87, 7b) and the downstream side of which communicates with the suction side or input 1'a of the compression means 1 or with the suction side or input of the first stage 1' of the compressor 1, (i) an intermediate return pipe-line 15 the upstream side of which communicates with the intermediate vaporization passage-way 10b and the downstream side of which communicates with the suction side or input 1''a of the other or second compression stage 1'', the suction side or input 1''a of the second compression stage 1'' communicating with the delivery or discharge side or output 1''b of the first compression stage 1'.

Means for fractionating the processed natural gas with a view to recover in a pure condition or as a mixture at least one part of the components heavier than methane may be provided in the passage-way for cooling the processed gaseous mixture between the ducts 7c and 8c.

The cooling plant previously described enables to cool a natural gas (processed gaseous mixture) by means of a refrigerating cycle of the closed-loop type making use of a cycle mixture comprising a plurality of components some of which are identical with those of the processed natural gas. The refrigerating cycle comprises the following steps of:

(a) carrying out a fractional condensation under the high pressure HP of the cycle mixture comprising:

a first stage of fractional condensation effected through the co-operation of the condenser 2 and of the first separator 4 during which the cycle mixture is partially condensed through heat exchange (within the condenser 2) with an outer coolant and the partially condensed cycle mixture is separated within the separator 4 into a first condensed fraction available at the liquid flow outlet 4c and a first vapour fraction available at the gaseous flow outlet 4*b* of the separator 4, a second or last stage of fractional condensation effected owing to the co-operation of the partial condensation duct 10*a* of the separator 5 and the total condensation duct 8*a*, during which the first or last but one vapour fraction of the cycle mixture is partially condensed within the duct 10*a* and the last but one or first partially condensed vapour fraction is separated within the separator 5 into a second or last vapour fraction available at the outlet 5*b* of the separator 5 and a last but one or second condensed fraction available at the liquid flow outlet 5*c* of the separator 5; finally the last or second vapour fraction is fully condensed within the duct 8*a* to obtain the last condensed fraction of the cycle mixture available at the outlet of the total condensation duct 8*a*.

The last or third condensed fraction is obtained through heat exchange (heat exchanging system 6) in counter-current flowing relationship exclusively with a refrigerating stream of the cycle mixture flowing through the vaporization passage-way (9*b*,98,8*b*,87,7*b*) while being reheated under the low pressure LP lower than the high pressure HP. Moreover the second and third condensed fractions of the cycle mixture are subcooled within the ducts 8*d* and 9*d*, respectively, through heat exchange in counter-current flowing relationship exclusively with this same refrigerating stream of the cycle mixture flowing through the vaporization passage-way previously defined.

(b) obtaining the second condensed fraction of the cycle mixture available at the liquid flow outlet 5*c* of the separator 5 and intermediate the first condensed fraction and third or last condensed fraction through partial condensation within the duct 10*a* of the foregoing vapour fraction or first vapour fraction available at the gaseous flow outlet 4*b* of the separator 4; this partial condensation is carried out through heat exchange in counter-current flowing relationship within the exchanger 10 exclusively with an intermediate refrigerating stream of the cycle mixture distinct from the aforementioned refrigerating stream under the low pressure and flowing through the intermediate vaporization passage-way 10*b* while undergoing a reheating step under the intermediate pressure IP lying between the low pressure LP and the high pressure HP, (c) effecting the full cooling of the natural gas inclusive of the final part of this cooling through heat exchange within the cooling passage-way (7*c*, 8*c*, 9*c*) in counter-current flowing relationship exclusively with the afore-mentioned refrigerating stream being reheated under the low pressure LP within the vaporization passage-way (9*b*, 98, 8*b*, 87, 7*b*), (d) expanding down to the low pressure LP within the third or last expansion means 13 all of the last or third condensed fraction of the cycle mixture and this expanded condensed fraction forms an initial part of the refrigerating stream flowing through the vaporization passage-way (9*b*, 98, 8*b*, 87, 7*b*), (e) expanding down to the low pressure LP within the second or last but one expansion means 12 all of another condensed fraction of the cycle mixture, i.e. the second condensed fraction preceding the third or last condensed fraction of said mixture and admixing within the connecting pipe-line 98 the expanded last but one or second condensed fraction to the refrigerating stream flowing through the vaporization passage-way (9*b*, 98, 8*b*, 87, 7*b*), (f) expanding within the first expansion means 11 down to the intermediate pressure IP all of another condensed fraction of the cycle mixture preceding the second condensed fraction or intermediate condensed fraction; more specifically all of the first condensed fraction is expanded down to the intermediate pressure IP within the valve 11 to form one initial part of the intermediate refrigerating stream flowing through the intermediate vaporization passage-way 10*b*; in the present instance the intermediate refrigerating stream consists of the whole amount of the expanded first condensed fraction, (g) compressing again the reheated refrigerating stream coming through the return pipe-line 14 from the vaporization passage-way (9*b*, 98, 8*b*, 87, 7*b*) for raising its pressure from the low pressure LP to the high pressure HP within the compression means 1 for restoring at least in part the cycle mixture under the high pressure HP available at the delivery or discharge side or output 1″*b* of the compressor 1; for this purpose the reheated refrigerating stream is at first compressed again up to the intermediate pressure IP within the stage 1′ of the compressor 1 and then the reheated intermediate refrigerating stream coming from the intermediate vaporization passage-way 10*b* through the return pipe-line 15 and combined with the foregoing recompressed refrigerating stream is compressed again for raising its pressure from the intermediate pressure IP up to the high pressure HP within the outer stage 1″ of the compressor 1.

According to the method described with reference to FIG. 1 it is found that in this form of embodiment of the invention:

the fractional condensation of the cycle mixture exlusively comprises two stages of fractional condensation corresponding to the separators 4 and 5, respectively, owing to which the last but one and last vapour fractions of the cycle mixtures are the first and second vapour fractions, respectively thereof available at the gaseous flow outlets 4*b* and 5*b*, respectively, of the separators 4 and 5 whereas the last but one and last condensed fractions of the cycle mixture are the second and third condensed fractions, respectively, thereof available at the liquid flow outlet 5*c* of the separator 5 and at the outlet from the total condensation duct 8*a*, respectively, the third condensed fraction of the cycle mixture is obtained through heat exchange of the second vapour fraction in counter-current flowing relationhip exclusively with the refrigerating stream flowing through the vaporization passage-way (9*b*, 98, 8*b*, 87, 7*b*) while being heated up under the low pressure LP, all of the second and third condensed fractions of the cycle mixture is expanded in the expansion means 12 and 13, respectively, down to the low pressure LP and the expanded third condensed fraction forms an initial part of the refrigerating stream flowing through the vaporization passage-way (9*b*, 98, 8*b*, 87, 7*b*) whereas the expanded second condensed fraction is admixed to this refrigerating stream within the pipe-line 98, the second condensed fraction of the cycle mixture available at the liquid flow outlet 5*c* is obtained through partial condensation of the first vapour fraction available at the gaseous flow outlet 4*b* through heat exchange in counter-current flowing relationship exclusively with the intermediate refrigerating stream flowing through the intermediate vaporization passage-way 10*b* and being heated up under the intermediate pressure IP, the first condensed fraction of the cycle mixture available at the liquid flow outlet 4*c* is fully expanded down to the intermediate pressure IP within the expansion means 11 and the first condensed fraction thus expanded forms the whole intermediate refrigerating stream flowing through the intermediate vaporization passage-way 10*b* of the exchanger 10.

Moreover it is found that the initial cooling and then the final cooling of the processed gaseous mixture (natural gas) are carried out through heat exchange (within the exchanging arrangement 6) in counter-current flowing relationship exclusively with the refrigerating stream being heated up under the low pressure LP within the vaporization passage-way (9*b*, 98, 8*b*, 87, 7*b*).

Furthermore the mean or average flow rate of the refrigerating stream flowing through the vaporization passage-way (9*b*, 98, 8*b*, 87, 7*b*) is largely in excess with respect to the mean or average flow rate of the gaseous mixture undergoing cooling and flowing through the cooling passage-way (7*c*, 8*c*, 9*c*); in this way the refrigerating stream is heated up to a final temperature lower than the ambient or room temperature and the refrigerating stream thus heated up is compressed again directly within the compressor 1. Therefore the suction at the inlet 1″*a* of the compression means 1 is carried out at a temperature lower than ambient or room temperature.

Figure 2:
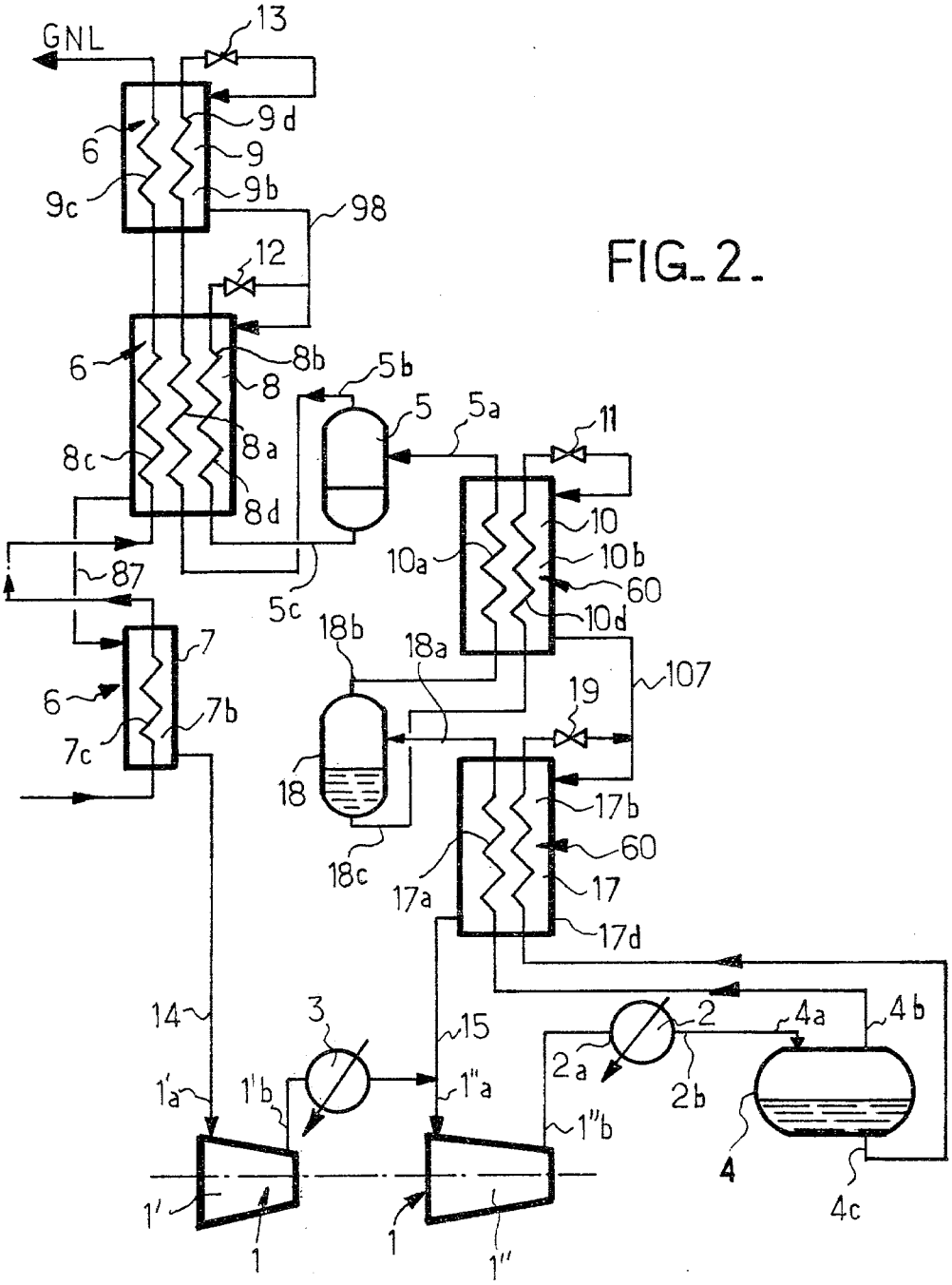

The cooling plant shown in FIG. 2 differs essentially from that shown in FIG. 1 by the fact that:

there is provided an additional separator 18 the two-phase flow inlet 18*a* of which communicates with the gaseous flow outlet 4*b* of the first separator 4 whereas its liquid flow outlet 18*c* communicates with the expansion means 11 through the agency of the sub-cooling duct 10*d* of the exchanger 10 and the gaseous flow outlet 18*b* of which communicates with the two-phase flow inlet 5*a* of the separator 5 through the agency of the partial condensation duct 10*a* of the exchanger 10, correlatively the intermediate heat exchanging assembly 60 comprises an additional exchanger 17; this exchanger comprises on the one hand a partial condensation duct 10*a* the inlet of which communicates with the outlet 4*b* of the separator 4 and the outlet of which communicates with the two-phase flow inlet 18*a* of the separator 18, on the other hand a sub-cooling duct 17*d* for the first condensed fraction of the cycle mixture the inlet of which communicates with the liquid flow outlet 4*c* of the separator 4 and the outlet of which communicates with the first expansion means 19 and finally an intermediate vaporization duct 17*b* in heat exchanging relationship with the partial condensation duct 17*a* and sub-cooling duct 17*d* communicating with the intermediate vaporization duct 10*b* through the agency of the connecting pipe-line 107. Accordingly the communication provided in series between the inside 10*b* of the casing of the exchanger 10, the connecting pipe-line 107 and the inside 17*b* of the casing of the exchanger 17 forms the intermediate vaporization passage-way of the intermediate heat exchanging assembly 60, correlatively there is provided another expansion means 19 the upstream side of which communicates with the liquid flow outlet 4*c* of the first separator 4 through the agency of the sub-cooling duct 17*d* whereas the downstream side of which communicates with the intermediate vaporization passage-way previously defined while opening or leading into the connecting pipe-line 107.

In a corresponding manner the cooling process used by the plant according to FIG. 2 differs from the process previously set forth only by the fact that the fractional condensation of the cycle mixture comprises the additional condensing step carried out between the first stage of fractional condensation corresponding to the separator 4 and the last stage of fractional condensation corresponding to the separator 5.

Correlatively the following differences may be stated:

the fractional condensation of the cycle mixture exclusively comprises three stages of fractional condensation corresponding to the separators 4,18 and 5, respectively, owing to which the last but one and last vapour fractions of the cycle mixture previously encountered now correspond respectively to the second and third vapour fractions of the cycle mixture available at the gaseous flow outlet 18*b* and 5*b*, respectively, of the separators 18 and 5; the last but one and last condensed fractions of the cycle mixture previously mentioned now correspond to the third and fourth condensed fractions, respectively, of the cycle mixture available at the liquid flow outlet 5*c* of the separator 5 and at the outlet of the total condensation duct 8*a*, respectively, the fourth condensed fraction of the cycle mixture is obtained through heat exchange of the third vapour fraction within the duct 8*a* in counter-current flowing relationship exclusively with the refrigerating stream flowing through the vaporization passage-way (9*b*, 98, 8*b*, 87, 7*b*) while being reheated under the low pressure LP, the third and fourth condensed fractions of the cycle mixture are fully expanded down to the low pressure LP within the expansion means 12 and 13; the expanded fourth condensed fraction forms an initial part of the refrigerating stream flowing through the vaporization passage-way defined previously whereas the expanded third condensed fraction is admixed to the refrigerating stream within the connecting pipe-line 98, the second and third condensed fractions of the cycle mixture available at the liquid flow outlets 18*c* and 5*c* of the separators 18 and 5 are obtained through partial condensations of the first and second vapour fractions, respectively, of the cycle mixture available at the gaseous flow outlets 4*b* and 18*b*, respectively, of the separators 4 and 18 through heat exchange in counter-current flowing relationship within the partial condensation ducts 17*a* and 10*a*, respectively, exclusively with the intermediate refrigerating stream flowing through the intermediate vaporization passage-way (10*b*, 107, 17*b*) while being heated up under the intermediate pressure, the first and second condensed fractions of the cycle mixture available at the liquid flow outlets 4*c* and 18*c* of the separators 4 and 18 are fully expanded down to the intermediate pressure IP; the second condensed fraction thus expanded within the expansion means 11 forms an initial part of the intermediate refrigerating stream previously defined whereas the firt condensed fraction expanded within the expansion means 19 is admixed to the intermediate refrigerating stream within the connecting pipe-line 107.

Figure 3:
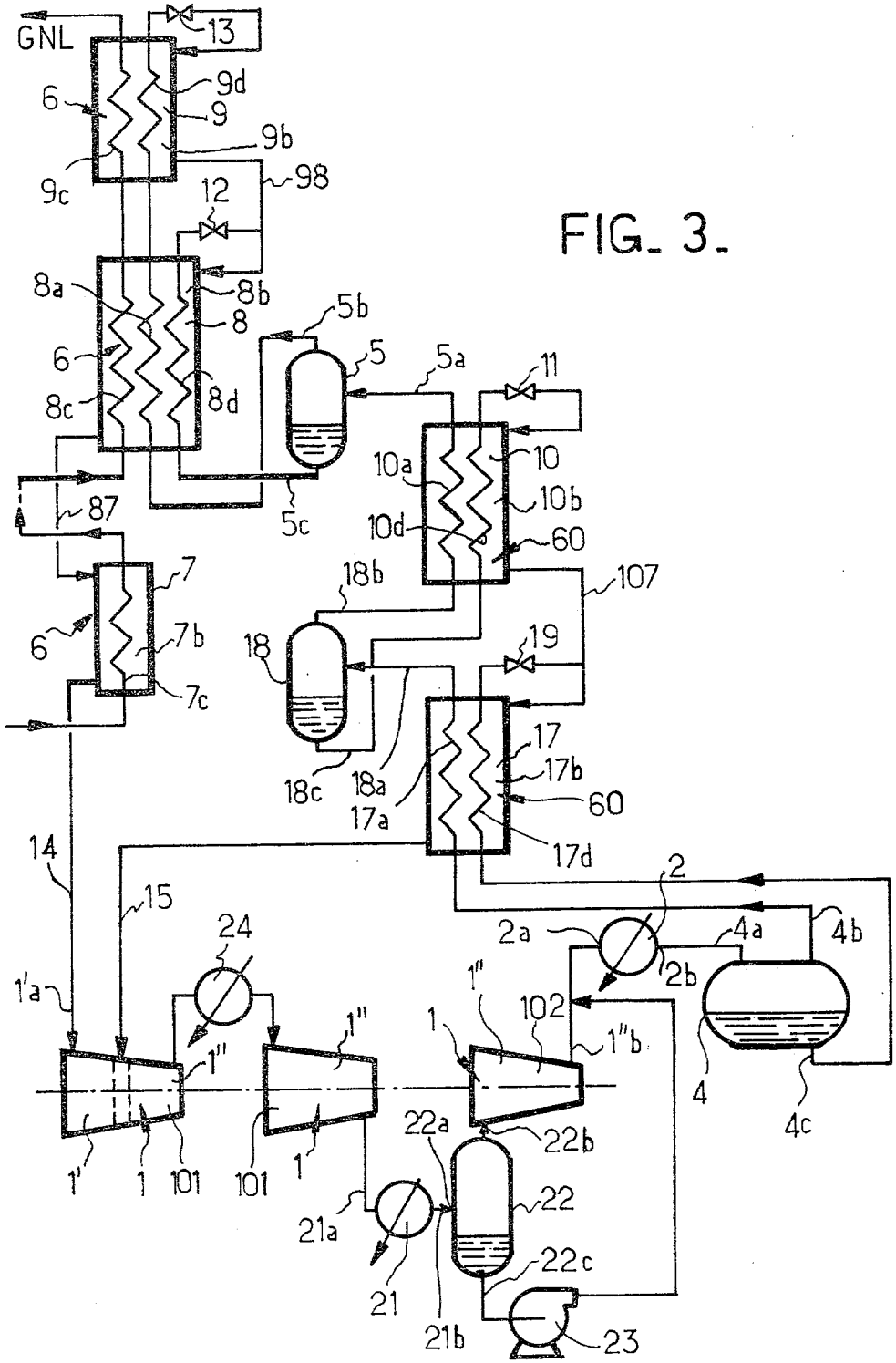

The cooling plant shown in FIG. 3 differs from that defined with reference to FIG. 2 essentially by the following points:

the other or second compression stage 1″ of the compression means 1 comprises two compression sub-stages 101 and 102 the suction and discharge or delivery sides of one(101) of which operates respectively under the intermediate pressure IP and a mean or middle pressure MP lying between the intermediate pressure IP and the high pressure HP whereas the suction and the delivery or discharge of the other (102) respectively operate at the mean pressure MP and at a pressure equal to the high pressure HP, there is provided an auxiliary condenser 21 the inlet 21*a* of which communicates with the delivery or discharge side or output of the first sub-stage 101 and comprising means for circulating an outer coolant, there is also provided an auxiliary separator 22 comprising a two-phase flow inlet 22*a* communicating with the outlet 21*b* of the auxiliary condenser 21, a gaseous flow outlet 22*b* communicating with the suction side or input of the second sub-stage 102 and a liquid flow outlet 22*c*, there is further provided an auxiliary pump 23 the upstream side of which communicates with the liquid flow outlet 22*c* of the auxiliary separator 22 whereas the downstream side thereof communicates with the two-phase flow inlet 4*a* of the first separator 4.

Correlatively the cooling method used according to FIG. 3 differs from that described with reference to FIG. 2 by the following points:

the reheated intermediate refrigerating stream coming from the duct 15 and combined with the refrigerating stream compressed again up to the intermediate pressure, which is delivered or discharged by the first stage 1' of the compression means 1 is compressed again in two successive compression steps one of which is carried out in the sub-stage 101 for raising the pressure from an initial pressure equal to the intermediate pressure IP up to the middle pressure MP whereas the other is effected in the sub-stage 102 for raising the pressure from the mean pressure MP up to a final pressure equal to the high pressure HP, the cycle mixture is partially condensed under the mean pressure MP within the auxiliary condenser 21 between the two compression stages 101 and 102 through heat exchange with an outer coolant, the cycle mixture thus partially condensed is separated within the auxiliary separator 22 into a gaseous fraction conveyed through the gaseous flow outlet 22*b* into the last compression stage 102 for being compressed again with a view to raise the pressure from the mean pressure MP to the final pressure HP and a liquid fraction carried through the liquid flow outlet 22*c* into the pump 23, this liquid fraction is compressed within the pump 23 for raising the pressure from the mean pressure MP to the high pressure HP and then directly added to the cycle mixture under the high pressure HP between the discharge or delivery side or output 1''*b* of the compression means 1 and the condenser 2 before carrying out the fractional condensation of the cycle mixture.

Figure 4:
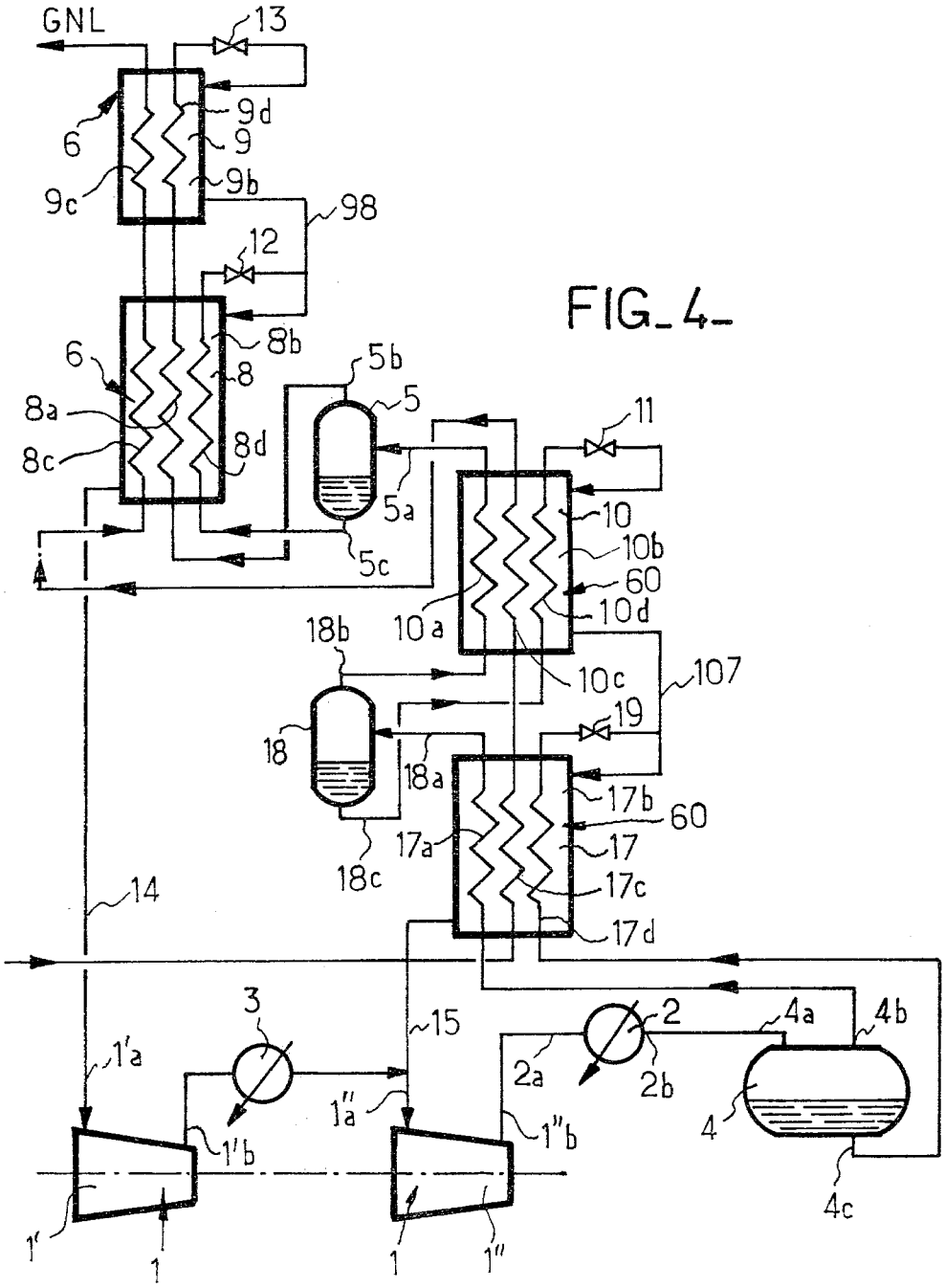

The cooling plant shown in FIG. 4 differs from that defined with reference to FIG. 2 essentially by the following point:

The intermediate heat exchange arrangement 60 comprises an intermediate cooling passage-way for the gaseous mixture, consisting of the series of cooling ducts 17*c* and 10*c* arranged in sequence within the exchangers 17 and 10, respectively; this cooling passage-way is therefore in heat exchanging relationship with the intermediate vaporization passage-way (10*b*, 107, 17*b*). Moreover this intermediate cooling passage-way (17*c*, 10*c*) communicates with the cooling passage-way (8*c*, 9*c*) of the heat exchanging system 6.

Correlatively the cooling method corresponding to the plant according to FIG. 4 differs from the way of operation of the plant shown in FIG. 2 only by the following point:

An initial cooling of the processed gaseous mixture is carried out through heat exchange in counter-current flowing relationship within the cooling passage-way (17*c*, 10*c*) exclusively with the intermediate refrigerating stream flowing through the intermediate vaporization passage-way (10*b*, 107, 17*b*) while being reheated under the intermediate pressure IP and then the final cooling of this same gaseous mixture is effected through heat exchange in counter-current flowing relationship within the cooling passage-way (8*c*, 9*c*) exclusively with the refrigerating stream flowing through the vaporization passage-way (9*b*, 98, 8*b*) while being reheated under the low pressure LP.

Figure 5:
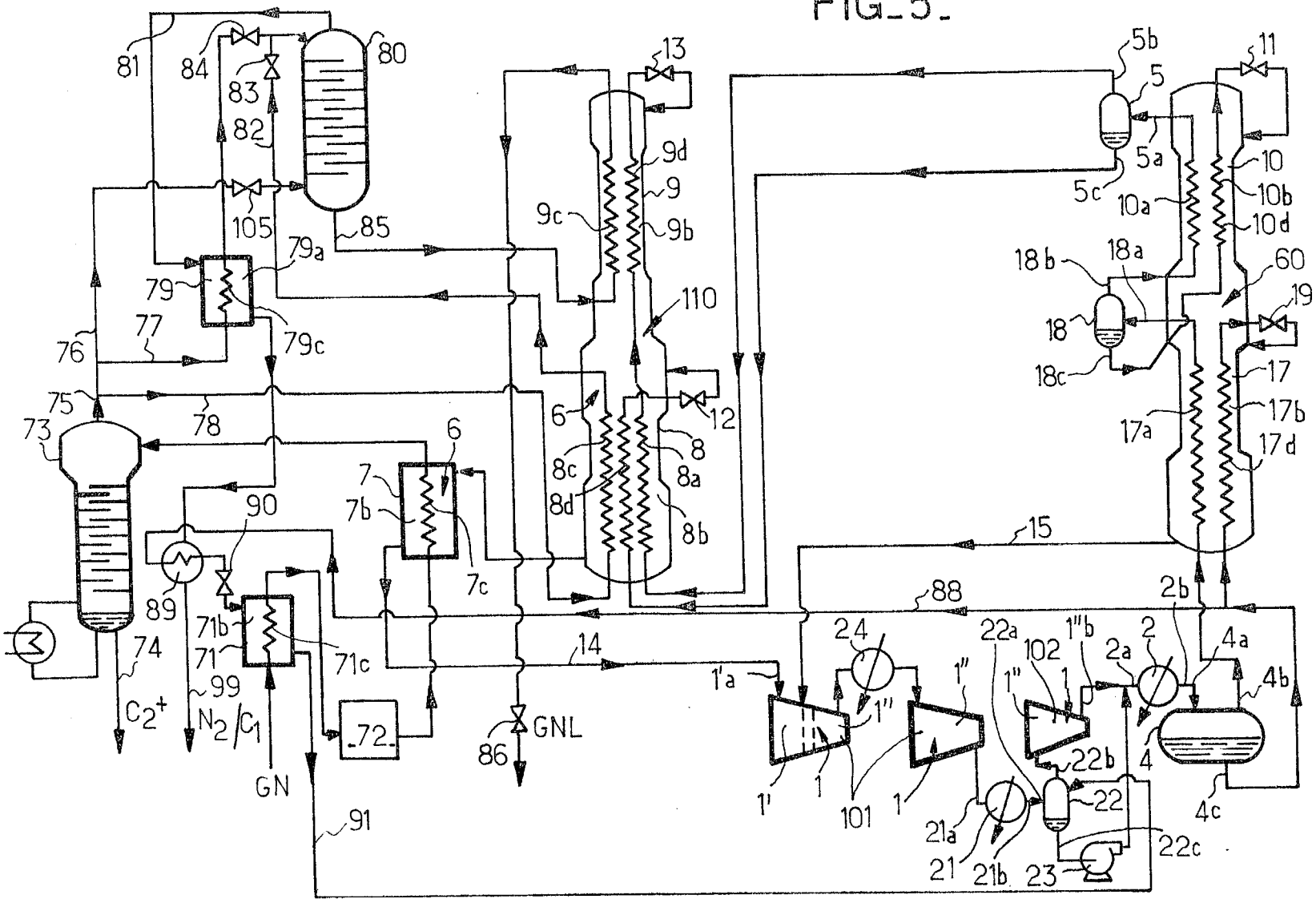

In FIG. 5 there has been shown another cooling plant for a gaseous mixture (natural gas) which distinguishes from the plant shown in FIG. 3 essentially by the following characterizing features:

(1) The intermediate heat exchanging assembly 60 consists of a single heat exchanger comprising a single casing inside of which are located the partial condensation ducts 17*a* and 10*a* of the first and second vapour fractions of the cycle mixture, the sub-cooling ducts 17*d* and 10*d* of the first and second condensed fractions of the cycle mixture. The inside of the casing of the exchanger 60 then performs the function of the vaporization passage-ways 17*b* and 10*b* of the intermediate refrigerating stream of the cycle. Correlatively the connecting pipe-line 107 is omitted or dispensed with and the expansion valves 11 and 19 communicate directly with the inside of the casing of the single heat exchanger 60, (2) the heat exchangers 8 and 9 are replaced by one single heat exchanger 110 comprising a single casing inside of which are arranged the total condensation duct 8*a* for the third vapour fraction of the cycle mixture, the sub-cooling duct 8*d* for the third condensed fraction of the cycle mixture, the sub-cooling duct 9*d* for the fourth condensed fraction of the cycle mixture and the cooling passage-way (8*c*, 9*c*) for the processed gaseous mixture (natural gas). The inside of the casing of the single exchanger 110 then performs the function of the vaporization passageways 8*b* and 9*b* for the refrigerating stream of the cycle. Correlatively the connecting pipe-line 98 is omitted or dispensed with and the expansion valves 12 and 13 communicate directly with the inside of the casing of the exchanger 110, (3) in the cooling passage-way for the natural gas are interposed:

on the one hand a rectifying column (or demethanizer) 73 between the cooling duct 7*c* of the exchanger 7 and the cooling duct 8*c* of the heat exchanging section 8 of the single exchanger 110; this column enables to remove hydrocarbons heavier than methane ($C_2$+) through the pipe-line 74, on the other hand a rectifying column (or denitrogenizer) 80 between the cooling duct 8*c* of the heat exchanging section 8 and the cooling duct 9*c* of the heat exchanging section 9 of the single exchanger 110; this column enables to remove a nitrogen/methane ($N_2/C_1$) mixture through the pipe-line 81.

Correlatively the top 75 of the column 73 communicates through the pipe-line 78 with the cooling duct 8*c* of the exchanger 110 whereas the cooling duct 7*c* communicates with the head or top of this same column 73.

Moreover the bottom sump of the column 80 communicates through the pipe-line 85 with the cooling duct 9c of the exchanger 110 whereas the cooling duct 8c for the natural gas communicates through the pipe-line 82 and the expansion valve 85 with the top or head portion of the column 80, (4) the upstream side of the cooling passage-way (7c, 8c, 9c) for the natural gas communicates with a dehydrating unit or device 72, (5) the inlet to the dehydrating unit or device 72 communicates with the outlet from a precooling exchanger 71; the latter comprises a precooling duct 71c in heat exchanging relationship with a passage-way 71b for the partial vaporization of one part of the first condensed fraction of the cycle mixture. The inlet to the passage-way 71b communicates with the liquid flow outlet 4c from the first separator 4 through the agency of a pipe-line 88, a sub-cooling exchanger 89 comprising a reheating passage-way 99 for the gaseous fraction rich in nitrogen ($N_2/C_1$) coming from the top or head portion 81 of the column 80 and through the agency of an expansion valve 90. The outlet from the passage-way 71b communicates through the pipe-line 91 with a two-phase flow inlet to the auxiliary separator 22.

(6) the top 75 of the rectifying column 73 communicates on the one hand with the bottom sump portion of the column 80 through a connecting pipe-line 76 in which is mounted an expansion valve 105 and on the other hand with the top or head portion of the latter column through a pipe-line 77 and an expansion valve 84; the connecting pipe-line 76 enables to convey to the column 80 a gaseous fraction providing for the heating of the latter. An exchanger for the condensation of the natural gas is arranged in the pipe-line 79 and comprises a condensation passage-way 79c in heat exchanging relationship with a passage-way 79a for heating up the gaseous fraction rich in nitrogen coming from the top portion of the column 80 through the pipe-line 81.

In a corresponding way the cooling method used in the plant shown in FIG. 5 differs from that defined with reference to FIG. 3 by the following characterizing features:

(1) the natural gas is precooled within the duct 71c of the exchanger 71 through heat exchange in counter-current flowing relationship with a part of the first condensed fraction of the cycle mixture (available at the liquid flow outlet 4c of the separator 4) while undergoing partial vaporization under the mean pressure MP within the vaporization passage-way 71b of the exchanger 71. For this purpose a part of the first condensed fraction of the cycle mixture is taken through the pipe-line 88 from the liquid flow outlet 4c of the separator 4, is sub-cooled within the exchanger 89 through heat exchange with a gaseous fraction of the natural gas rich in nitrogen while being heated up and coming from the outlet 81 of the column 80 and is eventually expanded within the valve 90 down to the mean pressure MP. This partially vaporized portion of the first condensed fraction is removed from the outlet of the exchanger 71 through the pipe-line 91 and is carried back into the auxiliary separator 22 for being added therein to the cycle mixture having been partially condensed between both compression sub-stages 101 and 102. In the auxiliary separator 22 the partially vaporized part coming from the pipe-line 91 and added to the partially condensed cycle mixture coming from the outlet 21b of the auxiliary condenser 21 is separated into the gaseous fraction conveyed into the compression stage 102 and the liquid fraction compressed within the pump 23 to the high pressure HP, (2) after having been precooled within the exchanger 71 and prior to being cooled within the heat exchanging assembly 6 the natural gas is dehydrated within the dehydrating unit 72, (3) after having been preliminarily cooled within the exchanger 7, the natural gas is subjected to a rectifying step within the column 73 in order to separate on the one hand the hydrocarbons heavier than methane ($C_2$+) through the pipe-line 74 and on the other hand through the pipe-line 75 the purified natural gas into said hydrocarbons. The major part of the natural gas thus purified is sent through the pipe-line 78 into the cooling passage-way (8c, 9c) of the heat exchanger 110. Another part of the natural gas thus purified is carried directly to the bottom sump portion of the column 80 through the pipe-line 76 and to the top or head portion of the column 80 through the pipe-line 77. The part conveyed through the pipe-line 77 is condensed within the exchanger 79 through heat exchange with the gaseous fraction rich in nitrogen coming from the top or head portion 81 of the column 80 while being reheated, (4) the condensed natural gas coming from the cooling duct 8c and expanded down to a lower pressure within the valve 83 is fed into the top of the column 80. Also the portions 76 and 77 of the natural gas are expanded within the valves 84 and 105, respectively, before being fed into the column 80. In the latter is effected a denitrogenization of the liquefied natural gas. Correlatively through the pipe-line 81 is removed a gaseous fraction rich in nitrogen which is successively heated up within the exchangers 79 and 89 before being removed from or drained off the plant. The liquefied and denitrogenized natural gas is removed from the bottom sump of the column 80 through the pipe-line 85 and sub-cooled within the duct 9c of the exchanger 110. The liquefied natural gas is eventually removed from the plant after having been expanded within the expansion valve 86 towards a storage tank or vessel.

By way of examplary illustration tables 1 and 2 given herebelow are listing various operating or working parameters of a cooling plant according to FIG. 5. In this plant the working pressures are the following (as expressed in effective bars):

HP: about 40 effective bars,
LP: about 1.4 effective bar,
IP: about 6 effective bars,
MP: about 18 effective bars.

The cooling method which has been set forth previously in the case of one single intermediate pressure between the high pressure and the low pressure of the refrigerating cycle may be extended in scope by stating with reference to the general definition of the invention that:

(i) there is obtained at least another condensed fraction of the cycle mixture which is intermediate or lying between said intermediate condensed fraction and the first condensed fraction through partial condensation of the vapour fraction preceding said other intermediate condensed fraction through heat exchange in counter-current flowing relationship with another intermediate refrigerating stream distinct from said refrigerating stream under low pressure and from said refrigerating stream under intermediate pressure while being reheated or heated up under another intermediate pressure lying between said intermediate pressure and the high pressure, (j) at least one part of at least one condensed fraction of the cycle mixture preceding said other intermediate condensed fraction is expanded down to said other intermediate pressure to form at least one part of said other intermediate refrigerating stream, (k) said other reheated intermediate refrigerating stream combined with said refrigerating stream and with said intermediate refrigerating stream and compressed again up to said other intermediate pressure is compressed again for raising the pressure from the latter to the high pressure.

TABLE 1

| Stream | Volumetric composition in % | | | | | | |
|---|---|---|---|---|---|---|---|
| | $N_2$ | $C_1$ | $C_2$ | $C_3$ | $iC_4$ and $nC_4$ | $iC_5$ and $nC_5$ | $C_6$ |
| Cycle mixture (at the inlet 2a of the condenser) | 4.64 | 22.60 | 47.84 | 12.11 | 7.41 | 5.40 | |
| Processed natural gas | 6.0 | 85.9 | 5.0 | 1.5 | 1.2 | 0.3 | 0.1 |

TABLE 2

| References of the circuit for natural gas | Pressure in effective bars | Temperature in °C. |
|---|---|---|
| Inlet 71c | 42.7 | 37 |
| Outlet 71c | 42.2 | 20 |
| Inlet 7c | 40 | 20 |
| Outlet 7c | 39.5 | −54 |
| Outlet 79c | 9.0 | −130 |
| Outlet 9c | 8.0 | −166 |

What is claimed is:

1. A method of liquifying and subcooling under pressure a gaseous mixture (NG) by means of a single refrigerating, closed-loop cycle with a cycle mixture comprising a plurality of components, said cycle mixture being compressed from a low pressure to a high pressure, refrigerated under said high pressure by an external coolant and thereafter expanded down to a lower pressure, wherein said refrigerating cycle comprises the steps of:

a. fractionally condensing under said high pressure and cycle mixture by successively:
   1. partially condensing said cycle mixture, which has been compressed (at 1") to said high pressure, through indirect heat exchange with said external coolant while said cycle mixture is thermally separated from and independent of said gaseous mixture in a first stage (2) of fractional condensation,
   2. separating (at 4) the resulting partially condensed cycle mixture (4*a*) into a first condensed fraction (4*c*) and a first vapor fraction (4*b*),
   3. subjecting said first vapor fraction (4*b*) to at least one further stage of fractional condensation (60; 17) at a temperature lower than that of the preceding stage of fractional condensation, said further stage of fractional condensation comprising the steps of:
      i. partially condensing (at 10*a*; 17*a*) the vapor fraction being processed;
      ii. separating (at 5; 18) the partially condensed fraction (5*a*, 18*a*) into a following condensed fraction (5*c*; 18*c*) and a following vapor fraction (5*b*; 18*b*),
      iii. expanding (at 11; 19) the preceding condensed fraction (4*c*) to a lower pressure which is intermediate said low pressure and said high pressue of said cycle,
      iv. spraying the resulting expanded fraction as at least one part of an intermediate refrigerating vapor stream (60; 10*b*, 17*b*) in counter-current indirect heat exchanging relationship with said preceding condensed fraction (10*a*, 17*a*) to subcool said preceding condensed fraction, thereby forming a reheated intermediate refrigerating vapor stream (15) consisting of those condensed fractions (17*d*, 10*d*) which had been expanded (at 19, 11) to said intermediate pressure and sprayed (at 17*b*, 10*b*, 107), and also consisting of the whole cycle mixture less said last (9*d*) and last but one (5*c*) condensed fractions,
      v. recovering from the last stage of said further stage of fractional condensation (60) and separation (5), a last but one condensed fraction (5*c*) and a last vapor fraction (5*b*),
   4. expanding (at 12) said last but one condensed fraction (5*c*) to said low pressure and spraying the resulting expanded fraction as at least one part of a final refrigerating vapor stream (6; 8*b*) in counter-current indirect heat exchanging relationship with
      i. said last but one condensed fraction (6; 8*d*) to subcool same, and
      ii. with said last vapor fraction (6; 8*a*) to condense same as a last condensed fraction (6; 9*d*),
   5. expanding (at 13) the last condensed fraction (6; 9*d*) to said low pressure and spraying the resulting expanded fraction as another part of said final refrigerating vapor system (6; 9*b*, 98) in counter-current indirect heat exchanging relationship with
      i. said last condensed fraction (6; 9*d*) to subcool same, and
      ii. with the last but one condensed fraction (6; 8*d*) to further subcool same in added relation to said one part of a final refrigerating vapor stream (14) consisting of the added last (9*d*) and last but one (15*c*9 condensed fractions which have been expanded (at 13, 12), respectively, to said low pressure,
   6. cooling, liquifying and subcooling the gaseous mixture (NG) under pressure (at 6; 7*c*, 8*c*, 9*c*) through heat exchange with at least said last condensed fraction (6; 8*a*, 9*d*) and in counter-current indirect heat exchanging relationship with at least said final refrigerating stream, the respective heat exchanges at said low pressure vaporizing and reheating the respective condensed fractions to form a reheated final refrigerating vapor stream (14);

b. recompressing (at 1') said reheated final refrigerating vapor stream (14) to raise the pressure thereof from said low pressure (1'*a*) to said intermediate pressure (1'*b*); and c. combining said final refrigerating vapor stream (14), after its compression to said intermediate pressure (1'*b*), with said reheated intermediate refrigerating vapor stream (15), and recompressing the resulting combined vapor stream (1"*a*) to raise its pressure from said intermediate pressure to said high pressure of cycle.

2. The method of claim 1, wherein said gaseous mixture (NG, 7*c*) to be liquified is preliminarily cooled (at 6; 7) in counter-current heat exchanging relationship with said reheated final refrigerating vapor stream (87, 7*b*)

before said gaseous mixture is cooled, liquified and subcooled.

3. The method according to claim 2, wherein said fractional condensation of said cycle mixture is effected in two stages (2,4;10,5) of fractional condensation and phase separation in which the last but one (4*b*) and last (5*b*) vapor fractions form a first (4*b*) and a second (5*b*) vapor fractions, respectively, of said cycle mixture, and the last but one (5*c*) and last (9*d*) condensed fractions form a second (5*c*) and a third (9*d*) condensed fractions, respectively, of said cycle mixture. (FIG. 1)

4. The method according to claim 2, wherein the fractional condensation of said cycle mixture is performed in three successive stages (2,4; 17,18; 10,5) of fractional condensation and phase separation in which the last but one (18*b*) and last (5*b*) vapor fractions form a second (18*b*) and a third (5*b*) vapor fractions, respectively, of said cycle mixture, and the last but one (5*c*) and last (9*d*) condensed fractions form a third (5*c*) and a fourth (9*d*) condensed fractions, respectively, of said cycle mixture. (FIG. 2)

5. The method according to claim 2, wherein said reheated intermediate refrigerating vapor stream (15) has been combind with said final reheated refrigerating vapor stream (14) and compressed up to said intermediate pressure, and is a. further compressed in at least two successive stages (101,102)
   1. a first compressive stage of which (101) is carried out from an initial pressure equal to said intermediate pressure up to a mean pressure (21*a*) lying between said intermediate pressure and said high pressure, and
   2. a second compression stage of which (102) is carried out from said mean pressure (21*a*) up to said high pressure (1″*b*),
b. said cycle mixture (21*a*) under said mean pressure between said first and second compression stages (101,102) is partially condensed (at 21) through heat exchange (at 21) with an external coolant,
c. said cycle mixture thus partially condensed is separated (at 22) into
   1. a gaseous fraction (22*b*) fed to said high pressure (1″*b*) and
   2. into a liquid fraction (22*c*) which is then compressed (at 23) from said mean pressure (22*c*) to said high pressure (1″*b*) and then added again directly to said cycle under said high pressure prior to effecting fractional condensation of said cycle mixture. (FIG. 3)

6. The method according to claim 5, wherein said gaseous mixture is a natural gas (NG) and said method further comprises: precooling said natural gas (at 71*c*) through heat exchange (at 71) in counter-current flowing relationship with one part (88,71*b*) of said first condensed fraction (4*c*) of said cycle mixture partially vaporized by expansion (at 90) to said mean pressure (22*b*) and adding said expanded part (71*b*) to said cycle mixture partially condensed (at 21,22) under said mean pressure. (FIG. 5)

7. The method according to claim 6, further comprising the steps of: subcooling said one part (88) of said first condensed fraction (4*c*) of said cycle mixture prior to its expansion (at 90) through heat exchange (at 89) with a nitrogen-enriched gaseous fraction (81,99) of said natural gas (NG), dehydrating (at 72) said precooled natural gas before being preliminarily cooled (at 7) through heat exchange with said final refrigerating vapor stream (7*b*); rectifying (at 73) the preliminary cooled natural gas to separate the hydrocarbons (74) heavier than methane from said natural gas for purifying same; condensing (at 8*c*) a major part (78) of said purified natural gas (75) through heat exchange with said last but one (8*d*) and last (8*a*) condensed fractions of cycle mixture and expanding (at 83) said condensed major part of a natural gas to a lower pressure; condensing (at 79) a first remaining part of said purified natural gas as a reflux through heat exchange (79*a*) with said nitrogen-enriched gaseous fraction of said natural gas and expanding (at 84) said condensed first remaining part of natural gas to a lower pressure; adding said expanded major part (82) and first remaining part (77) of said natural gas; expanding (at 105) a second remaining part (76) of said purified natural gas (75) and rectifying (at 80) said expanded major part (82) of purified natural gas, after having been admixed with said expanded reflux thereof, in counter-current heat exchanging relationship with said expanded second remaining part (76) of said purified natural gas in order to separate a nitrogen-enriched gaseous fraction of said natural gas from a liquified and denitrogenized fraction (85) of said natural gas; and sub-cooling the latter (at 9*c*) through heat exchange with said last condensed and subcooled fraction (9*d*) of said cycle mixture.

8. The method according to claim 1, wherein at least one part of the initial cooling (17*c*,10*c*) of said gaseous mixture (NG) is effected through heat exchange (60; 17,10) in counter-current flowing relationship with said intermediate refrigerating vapor stream (10*b*,107,17*b*,15) being sprayed and reheated under said intermediate pressure followed by final cooling of said gaseous mixture through heat exchange (6; 8,9) in counter-current flowing relationship with said final refrigerating vapor stream (9*b*,98,8*b*) being sprayed and reheated under said low pressure. (FIG. 4).

9. A plant for cooling and liquifying a gaseous mmixture (NG) by means of a single, closed-loop cycle mixture, comprising:

a. cycle mixture compressing means (1), the suction (1′*a*) and discharge (1″*b*) sides of which operate under a low pressure and a high pressure, respectively,
b. a plurality of successive fractional condensation and phase-separating stages interconnected in series and including:
   1. a first fractional condensation and phase-separation stage comprising
      i. a condenser (2) with means for circulating a single, external, cycle-mixture coolant and the inlet (2*a*) of which communicates with the high pressure discharge side (1″*b*) of said compression means (1), and
      ii. a separator (4) comprising a two-phase flow inlet (4*a*) communicating directly with the outlet (2*b*) of said condenser, a gaseous flow outlet (4*b*) and a liquid flow outlet (4*c*); and
   2. at least one intermediate fractional condensation and phase separation stage comprising
      i. an intermediate heat exchange (60; 17, 10)
      ii. an associated following separator (18,5) and
      iii. an expansion-spraying means (19,11);
   3. said intermediate heat exchanger comprising
      i. at least one partial condensation duct (17*a*, 10*a*) the outlet of which communicates with the two-phase flow inlet (18*a*, 5*a*) of said following separator and the inlet of which communicates with the gaseous flow outlet (4*b*, 18*b*) of the separator (4, 18) of the preceding fractional condensation and phase separation stage;

ii. a condensate duct (8*d*, 10*d*), the inlet of which communicates with the liquid flow outlet (4*c*, 18*c*) of the separator (4, 18) of said preceding fractional condensation and phase separation stage, and the outlet of which communicates with the upstream side of said expansion-spraying means (19,11); and iii. a vaporization passageway (17*b*, 10*b*) connected with its flow inlet to the downstream side of said expansion-spraying means (19, 11), and to the flow outlet (107) of the vaporization passageway of the heat exchanger of a following intermediate fractional condensation and vaporization stage, if present;

iv. said partial condensation duct, said condensate duct and said vaporization passageway extending in heat exchanging relationship with each other;

c. heat exchanger means (6; 8,9), downstream of and cooperating with the separator (5) of the last of said intermediate fractional condensation and phase separation stages, and comprising 1. a first expansion-spraying means, (12), and
2. a second expansion-spraying means (13);
3. at least one cooling duct (8*c*, 9*c*) for said gaseous mixture (NG) to be liquified;
4. at least one total condensation duct (8*a*, 9*d*) for said cycle mixture, the inlet of which communicates with the gaseous flow outlet of said last stage separator (5) and the outlet of which communicates with the upstream side of said second expansion-spraying means (13);
5. a condensate duct (8*d*) for said cycle mixture, the inlet of which communicates with the liquid flow outlet (5*c*) of said last stage separator (5) and the outlet of which communicates with the upstream side of said first expansion-spraying means (12); and
6. a vaporization passage-way (9*b*,98,8*b*) having two inlets communicating with said first and second expansion-spraying means (12,13), respectively; said cooling duct, said total condensation duct, said condensate duct and said vaporization passageway extending in heat exchanging relationship with each other;

d. a cycle mixture final return duct (14), the upstream end of which communicates with the outlet of said vaporization passageway (9*b*,8*b*), and the downstream end of which is connected to the low pressure suction side (1'*a*) of said compression means (1);

e. said compression means (1) comprising at least one first stage (1'), the suction (1'*a*) and delivery (1'*b*) sides of which respectively operate under said lower pressure and under an intermediate pressure lying between said low pressure and said high pressure, and a second stage (1''), the suction (1''*a*) and discharge (1''*b*) sides of which work under said intermediate pressure and said high pressure, respectively;

f. at least one cycle mixture intermediate return duct (15), the upstream end of which communicates with the outlet of the vaporization passage-way (17*b*) of the first intermediate fractional condensation and phase separation stage (60,17) and the downstream end of which communicates with the suction (1''*a*) of said second compression stage (1'') which suction (1''*a*) communicates with the discharge side (1'*b*) of said first compression stage (1').

10. A plant according to claim 9, wherein the heat exchanger (60; 10,17) of each intermediate fractional condensation and phase separation stage further comprises a precooling duct (17*c*,10*c*) for said gaseous mixture (NG) to be liquified, extending in indirect heat exchanging relationship with said intermediate vaporization passageway (17*b*,10*b*) and connected in series of said cooling duct (8*c*,9*c*) of said heat exchanger means (6; 8,9). (FIG. 4)

11. A plant according to claim 9, wherein:

said second compression stage (1'') of the compression means (1) comprises at least two compression sub-stages (101, 102), the suction and discharge sides of the first sub-stage (101) of which operate respectively at the intermediate pressure and at a means pressure lying between said intermediate pressure and said high pressure, and the suction and discharge sides of the second sub-stage of which (102) work respectively at said mean pressure and at a pressure at least equal to said high pressure, and including 1. an auxiliary condenser (21) the inlet (21*a*) of which communicates with the discharge side of said first compression sub-stage (101) and including means for circulating said external coolant,
2. an auxiliary separator (22) comprising a two-phase flow inlet (22*a*) communicating with the outlet (21*b*) of the auxiliary condenser (21), a gaseous flow outlet (22*b*) communicating with the suction side of said second compression sub-stage (102) and a liquid flow outlet (22*c*), and
3. an auxiliary pump (23), the upstream side of which communicates with the liquid flow outlet (22*c*) from the auxiliary separator (22), and the downstream side of which communicates with the two-phase flow inlet (1''*b*) to the condenser (2) of said first fractional condensation and phase separation stage (FIG. 3)

12. A plant according to claim 11, comprising further heat exchanging means (7) having a further vaporization passageway (7*b*) connecting said vaporization passage-way (9*b*,8*b*) to said cycle mixture final return duct (14) and a precooling duct (7*c*) for said gaseous mixture (NG) in indirect heat exchanging relationship with said further vaporization passage-way (7*b*) and communicating downstream with said cooling duct (8*c*,9*c*).

13. A plant for liquifying natural gas (NG) according to claim 12, comprising additional heat exchanger means (71) having an initial cooling duct 71*c*) for said natural gas (NG) connected with its downstream end to the upstream end of said precooling duct (7*c*), and a passage-way (71*b*) having its inlet connected through a first pipe-line (88) and an expansion means (90) to the liquid flow outlet (4*c*) of the separator (4) of said first fractional condensation and phase separation stage, whereas the outlet of said passage-way (71*b*) is connected through a second pipe-line (91) to the gaseous phase space of said auxiliary separator (22), said initial cooling duct (71*c*) being in indirect heat exchanging relationship with said passage-way (71*b*).

14. A plant according to claim 13, wherein said cooling duct (8*c*,9*c*) is divided into an upstream cooling portion (8*c*) and a downstream subcooling portion (9*c*) and said plant further comprising: a first auxiliary heat exchanger (89) having a subcooled duct connected in series into said first pipe-line (88) and a subcooling passage-way; a rectifying demethanizer column (73) having one top inlet connected to the downstream end of said precooling duct (7*c*) and one top outlet (75) connected through a pipe-line (78) to the upstream end of said cooling duct (8*c*), a rectifying denitrogenizer column (80) having a bottom sump portion outlet connected through a pipe-line (85) to the upstream end of said subcooling portion (9*c*) of said cooling duct and a bottom portion inlet connected through a pipe-line (76) fitted with an expansion valve (105) to said top outlet (75) of said demethanizer (73) and a top inlet connected through a pipe-line (82) fitted with an expansion valve (83) to the downstream end of the upstream cooling portion (8*c*) of said cooling duct, a second auxiliary heat exchanger (79) having a condensation duct (79*c*) forming a part of a reflux pipe-line (77) connecting said top outlet (75) of said demethanizer (73) to said top inlet of said denitrogenizer (80) through an expansion valve (84) and a heating passage-way (79*a*) in indirect heat exchanging relationship with said condensation duct (79*c*), the inlet of said passageway being connected through a pipe-line (81) to a top outlet of said denitrogenizer (80) whereas its outlet is connected through a pipe-line (99) to the subcooling passage-way of said first auxiliary heat exchanger; and a dehydrating device (72) inserted in the pipe-line connecting said initial cooling duct (71*c*) of said additional heat exchanger means to said precooling duct (7*c*) of said further heat exchanging means.

15. A plant according to claim 9, comprising further heat exchanging means (7) having a further vaporization passageway (7*b*) connecting said vaporization passage-way (9*b*,8*b*) to said cycle mixture final return duct (14) and a precooling duct (7*c*) for said gaseous mixture (NG) in indirect heat exchanging relationship with said further vaporization passage-way (7*b*) and communicating downstream with said cooling duct (8*c*,9*c*).

* * * * *

UNITED STATES PATENT AND TRADEMARK OFFICE

CERTIFICATE OF CORRECTION

PATENT NO. : 4,251,247

DATED : February 17, 1981

INVENTOR(S) : Joseph J. Gauberthier et al

It is certified that error appears in the above—identified patent and that said Letters Patent is hereby corrected as shown below:

Column 5, line 52, change "plurality" to --partially--.

Column 7, line 23, change "separate" to --separators--.

Column 10, line 29, change "outer" to --other--.

Column 15, line 5, change "85" to --83--.

Column 17, line 17, change "$C_6$" to --$C_6$+--.

Column 18, line 41, change "(15c9" to --(15c)--.

Column 19, line 24, change "combind" to --combined--.

Column 20, line 1, change "preliminary" to --preliminarily--;
lines 38-39, change "mmixture" to --mixture--.

Column 22, line 15, change "means" to --mean--;
line 48, change "71c)" to --(71c)--.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*